US010316558B2

(12) United States Patent
Patton et al.

(10) Patent No.: US 10,316,558 B2
(45) Date of Patent: Jun. 11, 2019

(54) APPARATUS AND METHOD FOR SECURING A DOOR

(71) Applicants: Brian T. Patton, Chicago, IL (US); James T. Brick, Chicago, IL (US); Luke Matthews, Chicago, IL (US); Douglas J. Willey, Chicago, IL (US)

(72) Inventors: Brian T. Patton, Chicago, IL (US); James T. Brick, Chicago, IL (US); Luke Matthews, Chicago, IL (US); Douglas J. Willey, Chicago, IL (US)

(73) Assignee: Class Safe LLC, Chicago, IL (US)

( * ) Notice: Subject to any disclaimer, the term of this patent is extended or adjusted under 35 U.S.C. 154(b) by 624 days.

(21) Appl. No.: 14/847,932

(22) Filed: Sep. 8, 2015

(65) Prior Publication Data

US 2016/0069110 A1 Mar. 10, 2016

Related U.S. Application Data

(60) Provisional application No. 62/145,742, filed on Apr. 10, 2015, provisional application No. 62/046,766, filed on Sep. 5, 2014.

(51) Int. Cl.

| | |
|---|---|
| ***E05C 19/18*** | (2006.01) |
| ***E05C 19/00*** | (2006.01) |
| *E05B 15/16* | (2006.01) |

(52) U.S. Cl.

CPC ..... *E05C 19/186* (2013.01); *E05C 19/004* (2013.01); *E05C 19/184* (2013.01); *E05B 2015/1692* (2013.01)

(58) Field of Classification Search

CPC ... Y10T 292/17; Y10T 292/34; Y10T 24/316; Y10T 403/7176; Y10T 24/318; Y10T 292/37; E05C 19/186; E05C 7/00; E05B 2015/1692; E05B 53/003; F16G 11/03; H02B 1/06

USPC ..... 292/253

See application file for complete search history.

(56) References Cited

U.S. PATENT DOCUMENTS

| | | | | |
|---|---|---|---|---|
| 8,616,593 | B2 * | 12/2013 | Bruce | E05C 17/042 24/298 |
| 2007/0018465 | A1 * | 1/2007 | Vassilakos | E05B 65/0014 292/216 |
| 2011/0133494 | A1 * | 6/2011 | Hopkins | E05C 19/18 292/253 |
| 2011/0290586 | A1 * | 12/2011 | Goldmann, II | A63B 27/00 182/3 |
| 2012/0217762 | A1 * | 8/2012 | Bruce | E05C 17/042 292/251.5 |
| 2013/0056998 | A1 * | 3/2013 | Chincarini, Jr. | E05C 17/36 292/262 |
| 2015/0204122 | A1 * | 7/2015 | Edwards | E05C 19/184 292/288 |

* cited by examiner

*Primary Examiner* — Mark A Williams
(74) *Attorney, Agent, or Firm* — Neal, Gerber & Eisenberg LLP

(57) ABSTRACT

Apparatus and methods are provided for securing a door against unauthorized entry.

17 Claims, 4 Drawing Sheets

APPARATUS AND METHOD FOR SECURING A DOOR

CROSS-REFERENCE TO RELATED APPLICATIONS

This application claims the benefit of U.S. Provisional Application No. 62/046,766, filed Sep. 5, 2014, and of U.S. Provisional Application No. 62/145,742, filed Apr. 10, 2015, each of which is hereby incorporated by reference in its entirety.

FIELD OF THE INVENTION

The present disclosure relates to apparatus and methods for securing a door against unauthorized entry, particularly an outward-opening door against an armed intruder.

BACKGROUND

School and building security has become an increasing concern. School officials, parents and the public at large engage in discussions and debates about ways of preventing violent tragedies at schools, including those perpetrated by intruders having firearms. Schools take proactive measures to protect the safety of students and staff. Schools have safety and security plans, and the actions taken during any type of emergency situation depend on the specifics of the situation. For example, a school may evacuate, lock down or initiate another response, according to the nature of the threat.

Ensuring that unauthorized persons do not enter the building can be challenging, since staff, volunteers, vendors and others may need to enter a building during and outside normal hours. Many schools use high security door locks can prevent unwanted visitors in the school. However, if someone else gets a key or code for the door locks, the lock must be changed. Other strategies employ video and/or audio surveillance in combination with dock locks controlled from the interior of the school or building. A visitor must identify himself or herself to an authorized person inside the school, who then can unlock the door manually or electronically. These strategies are effective for preventing unauthorized access from the exterior of the building but generally have not been used, and may be impractical, for individual classroom doors inside the school. Some have even suggested providing firearms to security officers and/or teachers inside school, which shows the level of concern about school shootings and the need for additional security strategies.

In many jurisdictions, regulations regarding fire safety require that doors in schools classrooms are outward-opening doors, in that the door swings into the hallway rather than into the classroom when it is opened. This facilitates rapid exit from the classroom if there is a fire. Panicked students may rush a door seeking escape, and a large huddled, panicked group could prevent a door from opening inwardly. Other school regulations prohibit the present of locks on classroom doors, since the ability to lock a classroom from the inside creates different safety and security concerns; if a misbehaving or troubled student were able to lock a classroom from the inside, there is a risk that other students or faculty could be in danger.

U.S. Pat. No. 8,397,348 discloses a binding strap device for securing cargo. It discloses several tightening mechanisms for a binding strap. US Publication No. 20070122247 discloses a cargo tightener and strap collector, and it also discloses a tightening mechanism. US Publication No. 20040253073 discloses a device for removably supporting a motorcycle on a vehicle for transportation by a strap assembly. U.S. Pat. No. 6,705,811 discloses a tie-down that includes two straps with hooks secured to their ends, the other end of a first strap being workable with a buckle to provide tension.

BRIEF SUMMARY OF THE INVENTION

Novel apparatus and methods are provided for securing a door, particularly an outward-opening door.

As one aspect of the present invention, door-securing apparatus are provided for preventing unauthorized entry into a room through a door. The apparatus comprise an elongated flexible restraint having a high tensile strength, a fastener at one or both ends of the elongated flexible restraint, an anchor secured in a stationary object inside the room, and a length adjuster adapted to change the length of the elongated flexible restraint. The first end of the elongated flexible restraint is removably, securely attached to the outward-opening door, and the second end of the elongated flexible restraint is securely attached to the stationary object via the anchor in a removable or permanent manner.

As another aspect of the present invention, kits are provided for installing and/or storing the door-securing apparatus described herein. For example, a kit can include an elongated flexible restraint, a length adjuster for adjusting the length of the elongated flexible restraint, one or more fasteners adapted for attachment to one or both ends of the restraint, and one or more anchors adapted for receiving the fasteners. With such a kit, the present apparatus can be installed for present or future use. As another example, a kit can include any of the apparatus described herein, along with a lockable container for storing the apparatus when the apparatus is not in place between the door and the stationary object. In some embodiments, the lockable container has an integral combination lock and/or is adapted for permanent attachment to a stationary object such as a wall. The combination can be kept secret and only disclosed to authorized personnel.

As another aspect of the present invention, methods are provided for securing a door against unauthorized entry into a room. The methods include fastening a first end of an elongated flexible restraint to an outward-opening door, and adjusting a length of the elongated flexible restraint so that the elongated flexible restraint is tight between the door and the stationary object. In some embodiments, the door is in an outward-opening door, such as the door of a school classroom. In other embodiments, the door is an upward-opening door, such as a garage door. In some embodiments, the methods include fastening a second end of the elongated flexible restraint to a wall. In some embodiments, a second end of the elongated flexible restraint is permanently attached to a wall.

As yet another aspect of the present invention, door-securing apparatus are provided for preventing unauthorized entry. The apparatus include a door having a first eyebolt attached to a door, a stationary object having a second eyebolt attached to the stationary object, an elongated flexible restraint having a first and a second end, a first carabiner attached to the first end of the restraint and to the first eyebolt, a second carabiner attached to the second end of the restraint and to the second eyebolt. The tightened elongated flexible restraint prevents the door from opening.

As yet another aspect of the present invention, door-securing apparatus are provided for preventing unauthorized entry. The apparatus include a door having a first eyebolt attached to a door, a stationary object having a second eyebolt attached to the stationary object, an elongated flexible restraint having a first and a second end, a first carabiner attached to the first end of the restraint and to the first eyebolt, and the second end of the restraint is permanently attached to the second eyebolt. The apparatus may also include a container attached to a stationary object and adapted for containing the flexible restraint when it is not in place between the door and the stationary object. The tightened elongated flexible restraint prevents the door from opening.

In some embodiments of the present invention, the length adjuster or means for adjusting the length is a cam buckle, which may have open and closed positions. A first section of the elongated flexible restraint is permanently attached to the cam buckle, and a second section of the elongated flexible restraint is movable through the cam buckle when the cam buckle is in the open position. In some embodiments, at least one of the fasteners is a carabiner at an end of the elongated flexible restraint. In some embodiments. The anchor is embedded in the stationary object and is adapted to receive the fastener so that the fastener is removably securely fastened to the anchor. For example, the fastener can be an eyebolt having a shaft and a protrusion on the shaft, and the anchor has a central bore with a recess to receive the protrusion. In some embodiments, the elongated flexible restraint is made of a flexible material that has a tensile strength of at least 10,000 psi when assessed by ASTM standard D638-10. In some embodiments, the second eyebolt is removable from the stationary object.

DETAILED DESCRIPTION OF THE INVENTION

The present disclosure provides an apparatus that secures a door against unauthorized entry and is easily put into place by a user. In particular, the apparatus can be used to secure an outward-opening door and prevent entry by an unauthorized intruder. Even if an armed intruder shoots the door knob and lock, the present apparatus can provide security and prevent entry. The present apparatus can also be used with an upward-opening door, which can be secured to an interior floor, thereby preventing entry by an unauthorized intruder.

In the present disclosure, certain parts may be removably or permanently attached to another part. A part is removably attached when it can be or is designed to be removed, separated, or disengaged from another part in the course of its normal usage. A part is permanently attached when it cannot be or is not designed to be removed, separated or disengaged from the other part in its normal usage, though the part may be separated through extraordinary means, such as by severing or unscrewing.

Figure 1:
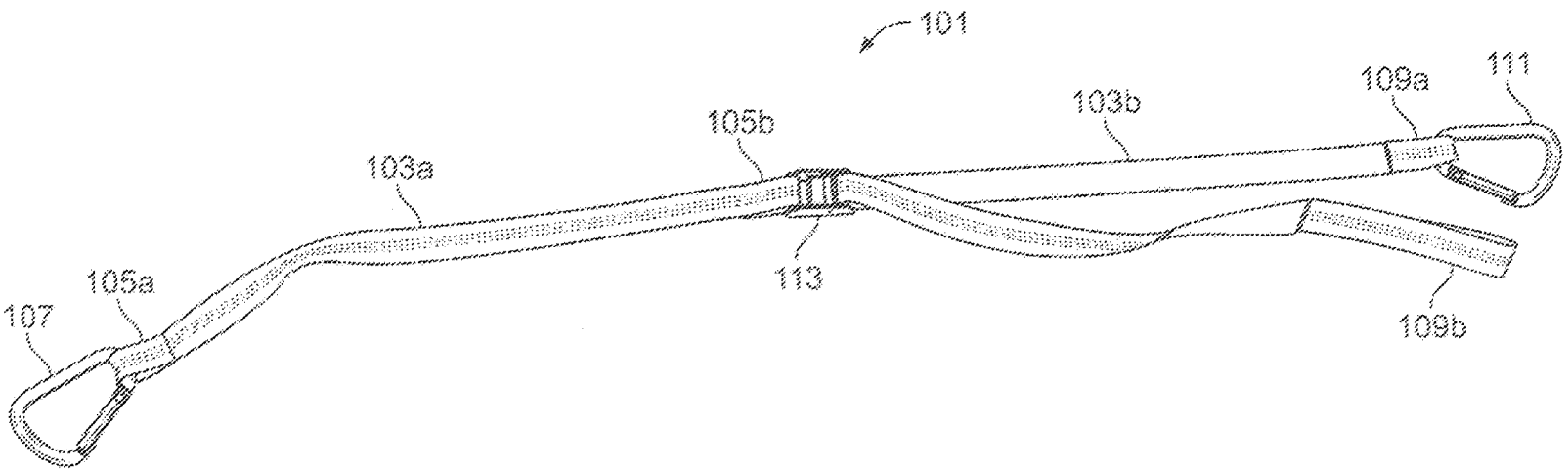
FIG. 1 shows an apparatus for securing a door against unauthorized entry.

FIG. 1 shows an apparatus for securing a door against unauthorized entry. The apparatus of FIG. 1 has an elongated flexible restraint comprising two sections 103*a* and 103*b*. The first section 103*a* has a loop 105*a* at a first end so that the first section 103*a* can be affixed to a first carabiner 107. The first loop 105*a* is formed by folding over the elongated flexible restraint and fastening it to itself, such as by stitching or an adhesive. The second section 103*b* of the elongated flexible restraint has loops 109*a* and 109*b* at both ends of the second section 103*b*. One loop 109*a* is fitted onto a second carabiner 111, and the second section is inserted through the clamping portion of a cam buckle 113 such that the other loop 109*b* is loose. When the cam buckle 113 is in an open position, the second section 103*b* can be made longer or shorter, as a result of one of the loops being pulled through the cam buckle 113. When a teacher or other authority wishes to put the apparatus in place, he attaches one carabiner to a door and the other carabiner to a stationary object in the room. He then adjusts (shortens) the length of the elongated flexible restraint so that it is tight between the door and the stationary object. This is done by pulling the loop 109*b* while the cam buckle 113 is in the open position, until the restraint is as tight as possible. When the cam buckle 113 is in the closed position, it holds the restraint, preventing it from passing through, thereby maintaining the restraint at the tightened length.

Figure 2A:
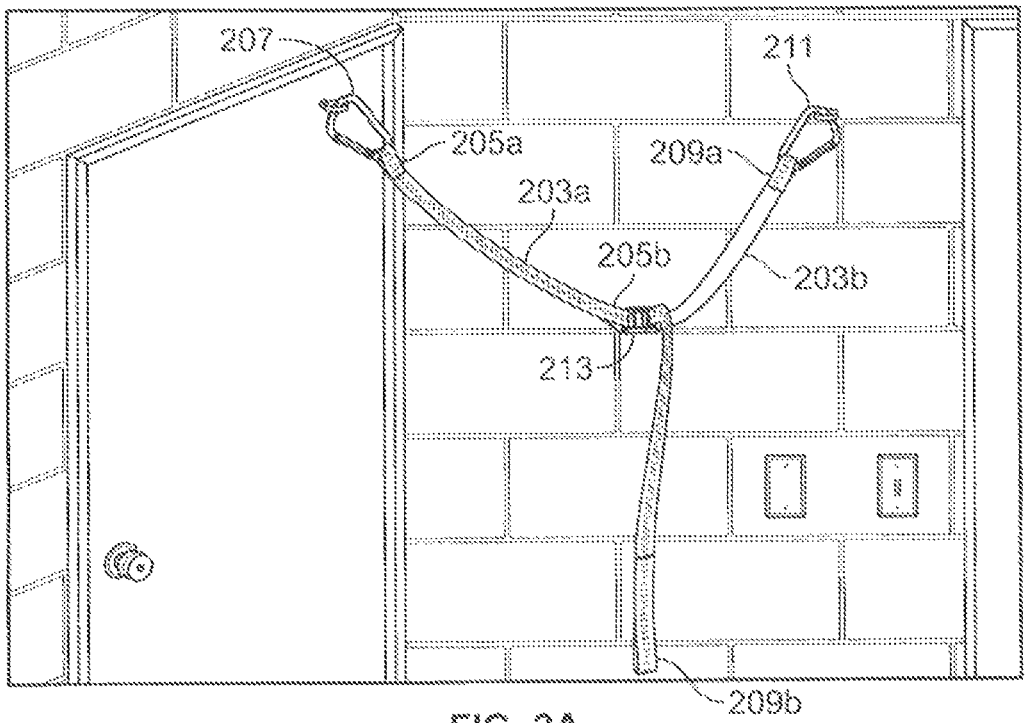
FIG. 2*a* shows an apparatus attached to a door and a wall before it is tightened.

FIG. 2*a* shows an apparatus attached to a door and a wall before it is tightened. The apparatus of FIG. 2*a* has an elongated flexible restraint comprising two sections 203*a* and 203*b*. The first section 203*a* has a loop 205*a* at a first end so that the first section 203*a* can be affixed to a first carabiner 207. The first loop 205*a* is formed by folding over the elongated flexible restraint and fastening it to itself, such as by stitching or applying an adhesive. The second section 203*b* of the elongated flexible restraint has loops 209*a* and 209*b* at both ends of the second section 203*b*. One loop 209*a* is fitted onto a second carabiner 211, and the second section is inserted through the clamping portion of a cam buckle 213 such that the other loop 209*b* is loose. In FIG. 2*a*, the apparatus is not tight between the wall and door. When a person wishes to make the apparatus tight so that the door is secured, she opens the cam buckle 213 (usually by pressing an end of a lever to release pressure by a cam against the flexible restraint) and pulls the loop 209*b* while the cam buckle 213 is in the open position, until the restraint is as tight as possible. The cam buckle 213 may have studs that engage the restraint when the cam buckle is in the closed position.

Figure 2B:
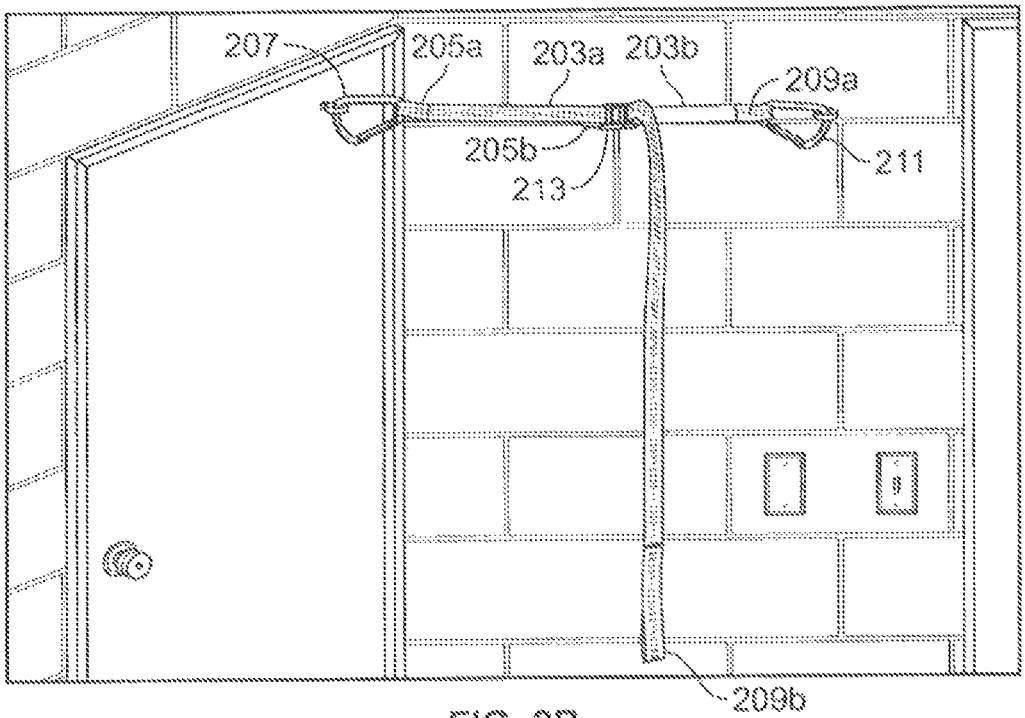
FIG. 2*b* shows the same apparatus after it has been adjusted so that it is tight between the door and the wall.

FIG. 2*b* shows the same apparatus as FIG. 2*a*, after it has been is tightened. The two sections 203*a* and 203*b* of the elongated flexible restraint are both tight, horizontal and approximately parallel with the floor. The cam buckle 213 is in its closed position, with the cam holding the flexible restraint securely in place. Because the restraint is tight between the door and the wall, it physically restrains the door from being opened in an outward direction. The apparatus is removably, securely attached at one end to the door and at an opposite end to a stationary object inside the room, such as a wall, post or column.

The flexible material of the elongated flexible restraint has a sufficiently high tensile strength to prevent the door from being opened by an unauthorized intruder. Tensile strength refers to the stress which the restraint material can withstand while being stretched or pulled without breaking. The tensile strength of the elongated flexible restraint should be greater than the amount of force that an intruder or a group of intruders can apply to a door handle. Tensile strength (also referred to as ultimate tensile strength) can be assessed using a standard technique, such as ASTM standard D638-10, and in some embodiments, the restraint has a tensile strength of at least about 10,000 psi, alternatively at least about 12,500 psi, alternatively at least about 12,500 psi, alternatively at least about 15,000 psi, alternatively at least about 20,000 psi, alternatively at least about 25,000 psi, alternatively at least about 50,000 psi.

The flexible restraint is substantially inelastic, meaning that it does not stretch or deform to a significant extent when stretched or pulled. For example, a substantially inelastic restraint substantially maintains its length, e.g., does not increase by more than 3%, alternatively not more than about 1%, alternatively not more than about 0.5%, when subjected to a stress of 10,000 psi. The flexible material of the elongated flexible restraint can have a Young's Modulus (or Modulus of Elasticity) sufficiently high so that it does not stretch and permit entry when an unauthorized intruder pulls on the door. In some embodiments, the flexible material has a Young's Modulus of 2 GPa (290,000 psi) or higher, alternatively 2.9 GPa (425,000 psi) or higher, alternatively, about 4 GPa (580,000 psi) or higher, alternatively about 10 GPa. Young's Modulus can be assessed by ASTM standard E111-04 (2010). Polyethylene terephthalate has a Young's Modulus of about 2 to 2.7; Nylon 6/6 has a Young's Modulus of about 2.9 GPa (425,000 psi); Aramid has a Young's Modulus of about 70.5 GPa (Kevlar 29) to 112.4 GPa (Kevlar 49) ($10.2\times10^6$ to $16.3\times10^6$ psi).

The elongated restraint can be made of any suitable material having the desired tensile strength and inelasticity. For example, the elongated restraint can be a suitable grade of polyamide (nylon), such as Nylon 6/6 GF30 (a glass-reinforced nylon), aromatic polyamides (such as Aramid or Kevlar), polyethylene terepthalates, polyimides (including glass-reinforced polymers), polyamide-imides, acetal copolymers (including glass-reinforced copolymers), and polystyrene. The flexible material can be a woven or non-woven material. In addition to polymeric materials, the flexible material can be wires or other metal.

In some embodiments, the elongated flexible restraint is one piece. In such embodiments, the elongated flexible restraint may have a constant length or it may have an adjustable length through the use of a cam lock, racket or other adjusting device. The elongated flexible restraint can be a strap and/or can comprise one or more pieces. In some embodiments, the strap comprises two pieces which are joined in the middle by an adjusting device.

The present apparatus can include a length adjuster or a means for adjusting the length of the elongated flexible restraint. The length adjuster is adapted for adjusting the length of the elongated flexible restraint and making it tight between the door and the stationary object. The length adjuster has open and closed positions; in the open position, the piece of strap can pass through, but in the closed position, the piece is firmly held. The length adjuster can be a cam lock, a buckle, a ratchet or other device. For example, FIGS. 2*a* and 2*b* show a cam buckle through which one piece of the elongated restraint passes through. The cam buckle has teeth so that the piece does not slip through. A cam buckle is advantageous as it requires only opening and closing, without manipulation of small parts, and it enables rapid fastening of the positioning of the elongated flexible restraint between the door and stationary object. The elongated restraint comprises a continuous second flexible strap 26 having a suitable buckle, such as cam buckle 28, attached to its middle end. The strap can be folded over and fastened to form a loop for attaching to a fastener or an anchoring member on the door or stationary object.

Alternatively, the length adjuster or means for adjusting is a buckle having a frame and a prong (like a belt buckle), so that the prong can be inserted into apertures in the other piece of the elongated flexible restraint. The apertures may have grommets to prevent tearing. Alternatively, the length adjuster can include a snap-fit buckle. In some embodiments, the elongated flexible restraint has a rotary tightening mechanism, such as shown in U.S. Pat. No. 8,397,348 or US Publication No. 20070122247.

In some embodiments, the length adjuster is a ratchet configured to control rotation of a spool. A first end of a first section of the elongated flexible restraint is attached to the spool in a manner that allows the elongated flexible restraint to wind around it. The ratchet has an engaged position in which the ratchet resists rotation of the spool in an unwind direction of the spool and a disengaged position in which the ratchet permits rotation of the spool in the unwind direction and a wind direction.

It is desirable that the elongated flexible restraint can be tightened as much as necessary so that the door cannot be opened and/or so that no gap can be created between the door and the door jam. The apparatus should prevent a door from partially opening wide enough for the nozzle of a firearm. In the apparatus shown in FIGS. 1, 2*a* and 2*b*, the restraining is tightened by opening the cam buckle and pulling down on the loop until the restraint is as tight as possible. Other suitable tightening mechanisms are disclosed in U.S. Pat. No. 8,397,348.

The apparatus comprises a fastener at each end of the elongated flexible restraint. Or the apparatus can comprise a means for fastening the elongated flexible restraint to a door or a stationary object inside the room. The fasteners are adapted for easy and quick attachment to the door and the stationary object. In some embodiments, at each end of the elongated flexible restraint are fasteners adapted for attachment to a door at one end and a wall, column, or other stationary object at the other end. The fastener can be any mechanism or design adapted for securely fastening an end of the elongated restraint to a door or stationary object, or an anchor attached thereto. The elongated restraint is securely fastened when it cannot be accidentally removed or easily dislodged when an intruder attempts to open the door. The fastener can be integral with the elongated flexible restraint; for example, the fastener can be a loop formed of the flexible material at the end of the elongated restraint. The loop can be fastened by slipping it onto a hook on the door or stationary apparatus. The fastener can be a hook, clasp, carabiner, bracket, or other device, or a combination of devices. For example, the fastener can be a hook, optionally a hook that forms a closed loop, which can be hooked onto an eyelet, post or other structure that is anchored to the door or stationary object. As an example of a combination, the fastener can comprise a loop through which a carabiner is passed. A carabiner is a metal loop with a spring-loaded gate or arm that can be used to quickly and reversibly connect an end of the elongated flexible restraint to a hook, loop or other component affixed to a stationary object. Alternatively, the elongated flexible restraint can have a male or female connector at its ends, which the corresponding female or male connector attached to the door and stationary object. In some embodiments, that fastener is a squared hook that fits over the top or side of the door.

Figure 3A:
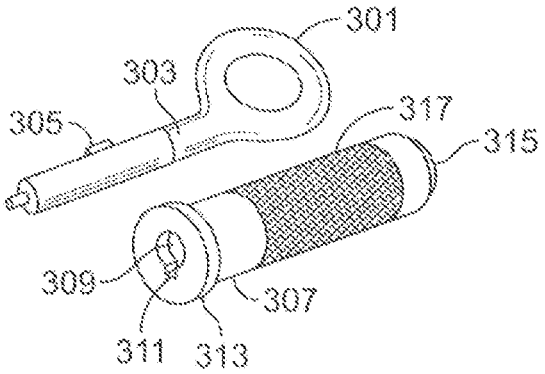
FIG. 3*a* shows an eyebolt and anchor for attaching a restraint to a door or a stationary object.

An anchor can be provided on the door and/or stationary object. In some embodiments, the anchor can be an eyebolt, hook, post, or other design in the stationary object to which a fastener of the elongated flexible restraint. In some embodiments, the anchor is a removable eyebolt. FIG. 3*a* shows a removable eyebolt and its complementary anchor. It is desirable that when the apparatus is not in place, there is no hardware left behind that an inappropriate party could use in an inappropriate way. It is also desirable to provide have quick and easy deployment of the device once a threat is known. In one embodiment, a nibbled eyelet is sewn to the strap. This eyelet is pushed into an anchor that was indexed and turned 90 degrees to lock. The reverse movement would remove the eyelet and leave only the anchor in the wall. The eyebolt has a tab or other protrusion or mechanism which allows the eyebolt to be removably securely attached or locked into the anchor. The anchor can be flush with the surface of the stationary object and/or can be concealed with a cover when the apparatus is not in use. Anchors suitable for cinderblock, drywall or other building materials can be selected.

Figure 3B:
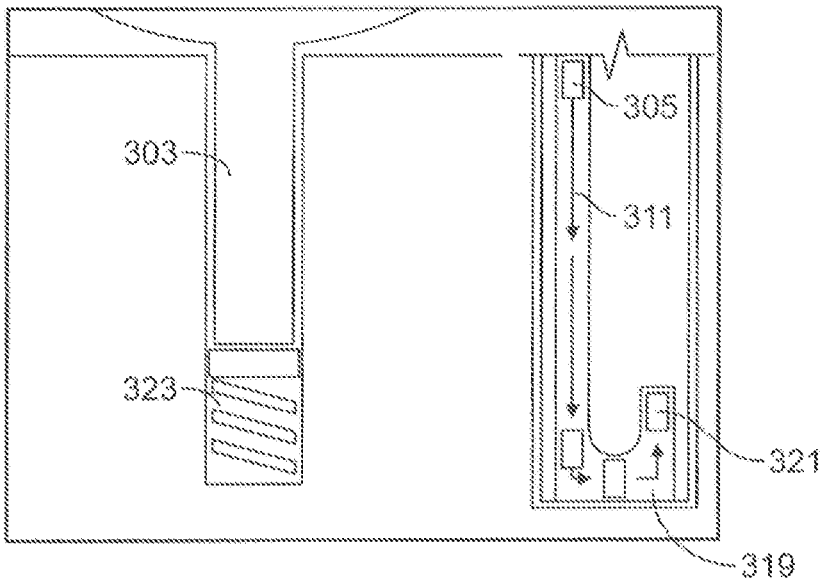
FIG. 3*b* depicts how an eyebolt with a tab can be securely attached in an anchor's central bore.

FIGS. 3*a* and 3*b* depict a simple design suitable for the present apparatus and methods. An eyebolt 301 has a shaft 303 which has a tab 305 or other protrusion. An anchor 307 has a central bore 309 for receiving the shaft 303. The central bore 309 includes a recess 311 along at least a portion of its length. The recess 311 is sized and shaped to accommodate the tab 305 on the shaft 303 of the eyebolt 301. The anchor can include a flange 313 at the end which may obtrude from the surface of the stationary object, and may provide a structure on which a cap may be placed, or it may be flush with the surface. The anchor also has a distal end 315 which can include a spring mechanism, or prongs, plates, or other features to secure the anchor in the wall. The sides of the anchor may have knurling 317, ridges or other texturing to further secure the anchor in place. FIG. 3*b* depicts how the eyebolt 301 can be removably securely attached to the anchor 307. The shaft 303 is inserted into the central bore 309 with the tab 305 aligned with and traveling through the recess 311. The recess 311 leads to horizontal recess 319 in the wall of the central bore 309. Upon reaching the horizontal recess 319, the eyebolt 301 can be turned until the tab 305 is positioned at a vertical slot 321 which engages the tab 321 and prevents the eyebolt 301 from being withdrawn from the anchor 307. The anchor 307 can have a spring 323 at the bottom of the central bore 309 to push the tab 305 into the slot 321. Alternatively, the eyebolt 301 may have a spring-loaded protrusion or portion at its bottom that pushes the tab 305 into the slot 321 after a user has put it in place.

As another example, the Keyanka Safety Eyebolt comprises an anchor that is permanently installed in a building wall and provides a socket adapted to receive an eyebolt. Keyanka safety eyebolts and anchors are available from Kee Safety Ltd. of Cradley Heath, West Midlands, United Kingdom. See, "Kee® i-bolt, Safety Eyebolt Solutions," Kee Safety Ltd. (2008).

In some embodiments, an end of the flexible restraint is permanently or removably attached to an installed anchor. For example, the flexible restraint can be passed through an eyebolt and fastened to itself by stitching or adhering. In this way, a loop is formed such that the loop and eyebolt interlink, and the loop permanently attaches the restraint to the eyebolt. This provides the advantage of allowing the restraint to be deployed by attaching only one end to an anchor. Alternatively, a loop at the end of the flexible restraint may slide into an eyebolt through a slit therein or onto a hook, thereby removably attaching the end of the flexible restraint to an installed anchor. The loop may be made from the same flexible material as the flexible restraint and be integral with the flexible restraint.

The apparatus may also include a container which is attached to a stationary object and adapted for containing the flexible restraint when it is not in place between the door and the stationary object. The container is permanently attached to a stationary object so as to surround an installed anchor attached to the stationary object. For example, an eyebolt can be installed in a wall, and the container can be permanently attached to the wall so as to surround the eyebolt. In embodiments where a flexible restraint is permanently attached to an installed anchor, the container can contain the elongated flexible restraint when it is not in use. This provides the advantage of having the restraint readily located and available for deployment. A first carabiner is attached to the first end of the restraint, and when the restraint is deployed, the carabiner is attached to the first eyebolt. The elongated flexible restraint is tightened and prevents the door from opening. The container can be lockable by key or combination lock, with the key or combination in the possession of authorized personnel. The container can be any shape or size that accommodates the anchor and optionally the restraint, such as a square or rectangular box. The box can be red and/or have markings to indicate that it should not be touched by unauthorized personnel and/or opened only in case of emergency.

Figure 4:
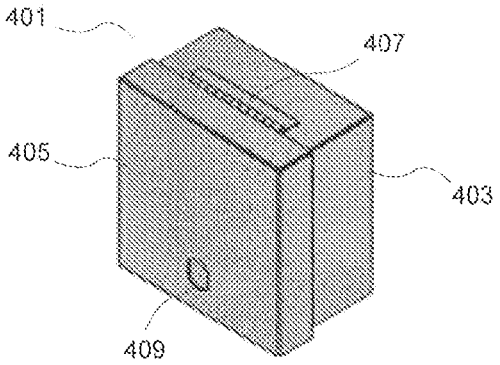
FIG. 4 shows a lockable container for containing an apparatus that is permanently attached to an installed anchor.

FIG. 4 shows a container for containing an apparatus that is permanently attached to an installed anchor. In this embodiment, the container 401 comprises a housing 403 and a cover 405, and a hinge 407 movably connects the housing 403 to the cover 405. The container includes a lock 409 so the container 401 is securely closed. The lock 409 can be any type of lock (key, combination, magnetic, biometric), and when the lock 409 is unlocked, the cover 405 can be opened, so that the door-securing apparatus can be accessed.

Preferably the present apparatus is not visible from the opposite side of the door on which it is fastened. By providing an apparatus that is not visible from outside the door, the risk of an intruder (including an intruder carrying firearms or other weapons) disabling the apparatus and gaining entry is reduced. An armed intruder will not know where to shoot the outside of the door so as to disable the apparatus. It may also be desirable to place the anchor on the door at different locations on different doors when installing the apparatus in multiple rooms of a building.

The elongated flexible restraint will generally be attached to a stationary object, usually one that is substantially perpendicular to the door. The stationary object can be a wall of the room, and it can extend in either direction (in the direction of the opening of the door, or opposite the direction of the door's opening). For example, when the stationary object is in the direction of the opening of the door, the elongated flexible restraint can wrap around a corner. Alternatively, the stationary object can be a pillar or post in the room. In some embodiments, the stationary object can be the floor or ceiling of the room. The stationary object should be a part of the building structure and not moveable under normal circumstances.

The present apparatus includes kits comprising the elongated flexible restraint and one or more anchors for attachment to a door and/or a wall.

In some embodiments, the apparatus is designed so that there is no hardware protruding from the door and/or stationary object when the apparatus is not in place. In many schools, it is undesirable to have a lock or other elements that could be used to fashion a lock, on a classroom door so that a party cannot inappropriately lock the door and detain themselves or others. Accordingly, the present apparatus can include nibbled eyelet that would be sewn to the strap and an anchor that is inserted in the door and/or stationary object. This eyelet would be pushed into an anchor that was indexed and turn 90 degrees and lock. The reverse movement would remove the eyelet and leave only the anchor in the wall.

Unauthorized entry into a classroom refers generally to entry of persons who are not authorized to enter the room by the teacher inside the room and/or by school administrators. However, the present apparatus and methods are not limited to schools and classroom. For example, they may be used in homes, government buildings, offices, churches or other places of worship, or elsewhere. Moreover, the room may be any interior space closed off from another area or environment. For example, the room may be a garage interior, and the stationary object may be its floor. The present apparatus can be used to secure the garage door from being opened by an intruder, thereby preventing unauthorized entry.

In the present specification, use of the singular includes the plural except where specifically indicated. In the present specification, any of the functions recited herein may be performed by one or more means for performing such functions.

All patents cited herein are fully incorporated by reference to the extent such disclosure is not inconsistent with this apparatus and for all jurisdictions in which such incorporation is permitted.

While the presently disclosed apparatus has been described and illustrated by reference to particular embodiments, it will be appreciated by those of ordinary skill in the art that the invention lends itself to many different variations not illustrated herein. Accordingly, the scope of the present invention is not limited to any particular embodiment but rather is defined by the appended claims.

Although the dependent claims have single dependencies in accordance with U.S. patent practice, each of the features in any of the dependent claims can be combined with each of the features of other dependent claims or the main claim.

The invention claimed is:

1. A kit comprising:

(a) a door-securing apparatus for preventing unauthorized entry into a room through a door, the apparatus comprising:

an elongated flexible restraint having a high tensile strength;

one or more fasteners at one or both ends of the elongated flexible restraint;

an anchor securable to a stationary object inside the room;

a length adjuster adapted to change a length of the elongated flexible restraint;

wherein a first end of the elongated flexible restraint is removably, securely attachable to the door, and the second end of the elongated flexible restraint is securely attachable to the stationary object via the anchor; and (b) a lockable container for storing the apparatus when the apparatus is not in place between the door and the stationary object.

2. The kit of claim 1 wherein the length adjuster is a cam buckle.

3. The kit of claim 2, wherein the cam buckle has open and closed positions, and a first section of the elongated flexible restraint is permanently attached to the cam buckle, and a second section of the elongated flexible restraint is movable through the cam buckle when the cam buckle is in the open position.

4. The kit of claim 1, wherein at least one of the fasteners is a carabiner at an end of the elongated flexible restraint.

5. The kit of claim 1, wherein the anchor is embedded in the stationary object and is adapted to receive the fastener so that the fastener is removably securely fastened to the anchor.

6. The kit of claim 1, wherein the anchor is embedded in the stationary object, and one of the ends of the restraint is permanently attached to the anchor.

7. The kit of claim 1, wherein the elongated flexible restraint is made of a flexible material that has a tensile strength of at least 10,000 psi when assessed by ASTM standard D638-10.

8. The kit of claim 1, wherein the lockable container has an integral combination lock.

9. The kit of claim 1, wherein the lockable container is adapted to be permanently attached to a wall.

10. The kit of claim 1, wherein the length adjuster is a ratchet.

11. A method for securing a door against unauthorized entry into a room, the method comprising:

(a) providing a door-securing apparatus for preventing unauthorized entry into a room through a door, the apparatus comprising:

an elongated flexible restraint having a high tensile strength;

one or more fasteners at one or both ends of the elongated flexible restraint;

an anchor securable to a stationary object inside the room;

a length adjuster adapted to change a length of the elongated flexible restraint;

wherein a first end of the elongated flexible restraint is removably, securely attachable to the door; and (b) fastening the first end of the elongated flexible restraint to a door, wherein the second end of the elongated flexible restraint is permanently attached to a stationary object inside the room; adjusting the length of the elongated flexible restraint so that the elongated flexible restraint is tight between the door and the stationary object; and (c) providing a lockable container for storing the apparatus when the apparatus is not in place between the door and the stationary object.

12. The method of claim 11, wherein the door is in an outward-opening door.

13. The method of claim 11, wherein the elongated flexible restraint comprises a cam buckle or a ratchet adapted for adjusting the length of the elongated flexible restraint.

14. A kit comprising:

(a) door-securing apparatus for preventing unauthorized entry, the apparatus comprising:

a door having a first eyebolt attached to a door;

a stationary object having a second eyebolt attached to the stationary object;

an elongated flexible restraint having a first and a second end;

a first carabiner attached to the first end of the restraint and to the first eyebolt;

wherein the second end of the restraint is permanently attached to the second eyebolt;

wherein the tightened elongated flexible restraint prevents the door from opening; and (b) a lockable container for storing the apparatus when the apparatus is not in place between the door and the stationary object.

15. The apparatus of claim 14, further comprising a length adjuster on the elongated flexible restraint which is adapted for adjusting the length of the elongated flexible restraint and making it tight between the door and the stationary object.

16. The kit of claim 14, wherein the stationary object is a wall of a room.

17. The kit of claim 14, wherein the stationary object is a floor of a room.

* * * * *